United States Patent [19]

Scheerhorn

[11] 4,445,729

[45] May 1, 1984

[54] OVER-CENTERED LOCK ARRANGEMENT FOR OFFICE FURNITURE UNITS

[75] Inventor: Douglas Scheerhorn, Grand Rapids, Mich.

[73] Assignee: Steelcase Inc., Grand Rapids, Mich.

[21] Appl. No.: 362,452

[22] Filed: Mar. 26, 1982

[51] Int. Cl.[3] ..... F05B 65/46

[52] U.S. Cl. ..... 312/219; 292/167; 292/DIG. 49

[58] Field of Search ..... 292/139, 167, DIG. 49; 312/218, 219, 221, 222, 107.5

[56] References Cited

U.S. PATENT DOCUMENTS

| | | | |
|---|---|---|---|
| 508,541 | 11/1893 | Gray | 292/167 |
| 1,109,086 | 9/1914 | Stuck | 312/107.5 |
| 1,613,731 | 1/1927 | Stockov | 312/221 |
| 3,123,417 | 3/1964 | Bullock | 312/221 |
| 3,360,318 | 12/1967 | Studinski | 312/217 |
| 3,385,642 | 5/1968 | Schreyer | 312/195 |
| 3,521,937 | 7/1970 | Buhrmaster et al. | 312/217 |
| 3,764,190 | 10/1973 | Anderson | 312/286 |
| 3,834,780 | 9/1974 | McClellan et al. | 312/219 |
| 3,857,621 | 12/1974 | Scheerhorn et al. | 312/219 |
| 3,924,884 | 12/1975 | Christie | 292/DIG. 49 |
| 3,968,984 | 7/1976 | Guth | 292/DIG. 49 |
| 4,057,307 | 11/1977 | Scheerhorn | 312/219 |
| 4,092,056 | 5/1978 | Signore et al. | 312/219 |
| 4,202,587 | 5/1980 | Wieland | 312/219 |

*Primary Examiner*—James T. McCall
*Assistant Examiner*—Joseph Falk
*Attorney, Agent, or Firm*—Price, Heneveld, Huizenga & Cooper

[57] ABSTRACT

An over-centered lock arrangement is provided for office furniture units, such as desks, credenzas and the like, that include one or more pedestals, having at least one closable compartment, in the nature of a drawer, a cabinet, et cetera, with a mechanism to lock the compartment closed, and a top extending the length of the unit. A primary lock is mounted in the unit, and includes lock tumblers mounted in a plug or cylinder, which is rotatable between the locked and unlocked positions. At least one lock slide is slidably mounted in the unit, and reciprocates to shift the compartment lock between locked and unlocked positions. The cam lock assembly includes a crank arm connected with the tumbler cylinder, and an actuator arm having opposite ends pivotally connected with the crank arm and the lock slide at first and second pivot points, whereby rotation of the tumbler cylinder reciprocates the lock slide. In the locked position, the first and second pivot points assume an over-centered relationship with respect to the axis of rotation of the tumbler cylinder, whereby external forces applied to the lock slide in a direction to force the lock open, urge the tumbler cylinder further toward the locked position for improved security, and to prevent damage to the lock tumblers.

21 Claims, 11 Drawing Figures

OVER-CENTERED LOCK ARRANGEMENT FOR OFFICE FURNITURE UNITS

CROSS-REFERENCE TO RELATED APPLICATION

The present application is related to my copending, U.S. patent application Ser. No. 362,454 filed Mar. 26, 1982, entitled Lock Arrangement for Office Furniture Units, which is hereby incorporated by reference.

BACKGROUND OF THE INVENTION

The present invention relates to office furniture units, and in particular to an over-centered lock arrangement therefor.

Lock arrangements for desks, credenzas and other similar office furniture units and/or work stations are generally known in the art. Some lock arrangements, such as those disclosed in U.S. Pat. Nos. 4,057,307; 3,360,318 and 3,521,937 employ a side-to-side shifting action to lock and unlock the pedestal compartments. Connectors, such as rods, sliding channels and flexible cables have been used to connect a crank arm on the primary lock with the compartment lock to laterally shift the same between lock and unlocked positions.

When such prior lock arrangements are in the locked positions, external forces applied to the connector in a direction to force the lock open are transmitted directly to the lock tumblers. Such external forces can result from slight misalignment between the pedestals and the top. Although these forces are relatively small, they can cause difficulty in inserting and withdrawing the key, or rotation of the tumbler cylinder, as well as premature tumbler wear. External forces can also result from tampering or attempts to surreptitiously enter the furniture unit. In such cases, the forces are relatively high, and typically cause substantial damage to the lock tumblers, such that the entire lock must be replaced.

SUMMARY OF THE INVENTION

One aspect of the present invention is an over-centered lock arrangement for office furniture units, comprising a cam lock assembly which prevents the transmission of external forces to the lock tumblers. The lock assembly comprises a crank arm extending radially of the axis of rotation of the tumbler cylinder, and an actuator arm having opposite ends pivotally connected with the crank arm and the the lock slide at first and second pivot points respectively, whereby rotation of the tumbler cylinder reciprocates the lock slide between the locked and unlocked positions. In the locked position, the first and second pivot points assume an over-centered relationship with respect to the axis of rotation of the tumbler cylinder, whereby external forces applied to the lock slide in a direction to force the lock open, urge the tumbler cylinder further toward the locked position for improved security, and to prevent damage to the lock tumblers.

The principal objects of the present invention are to provide an over-centered lock arrangement for office furniture units, which prevents the transmission of external forces to the lock tumblers, thereby providing increased security, and preventing damage to the lock tumblers as a result of tampering. The over-centered lock arrangement also greatly alleviates wear on the lock tumblers during normal operation, and provides smoother lock action. The over-centered lock arrangement is efficient in use, economical to manufacture, capable of a long operating life, and particularly well adapted for the proposed use.

These and other features, advantages and objects of the present invention will be further understood and appreciated by those skilled in the art by reference to the following written specification, claims and appended drawings.

DETAILED DESCRIPTION OF THE PREFERRED EMBODIMENTS

Figure 1:
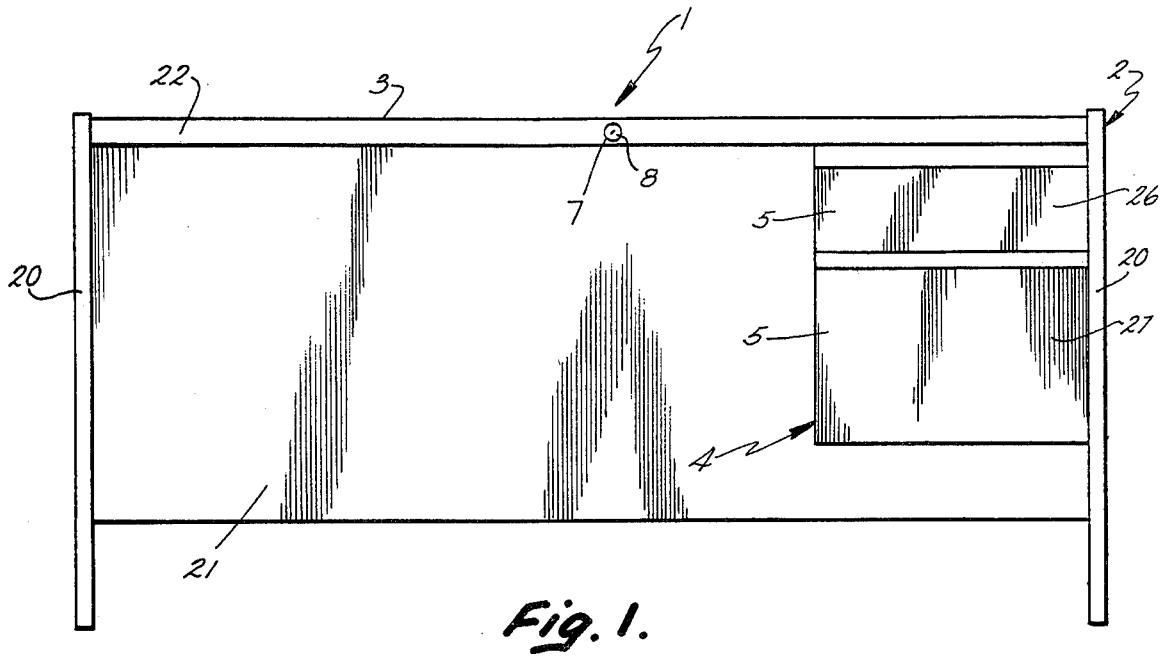
FIG. 1 is a front elevational view of an office furniture unit in which an over-centered lock arrangement embodying the present invention is installed.
Figure 2:
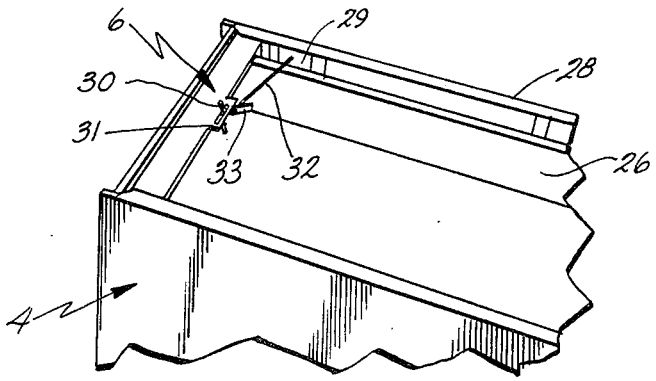
FIG. 2 is a fragmentary, perspective view of a pedestal for the office furniture unit.
Figure 3:
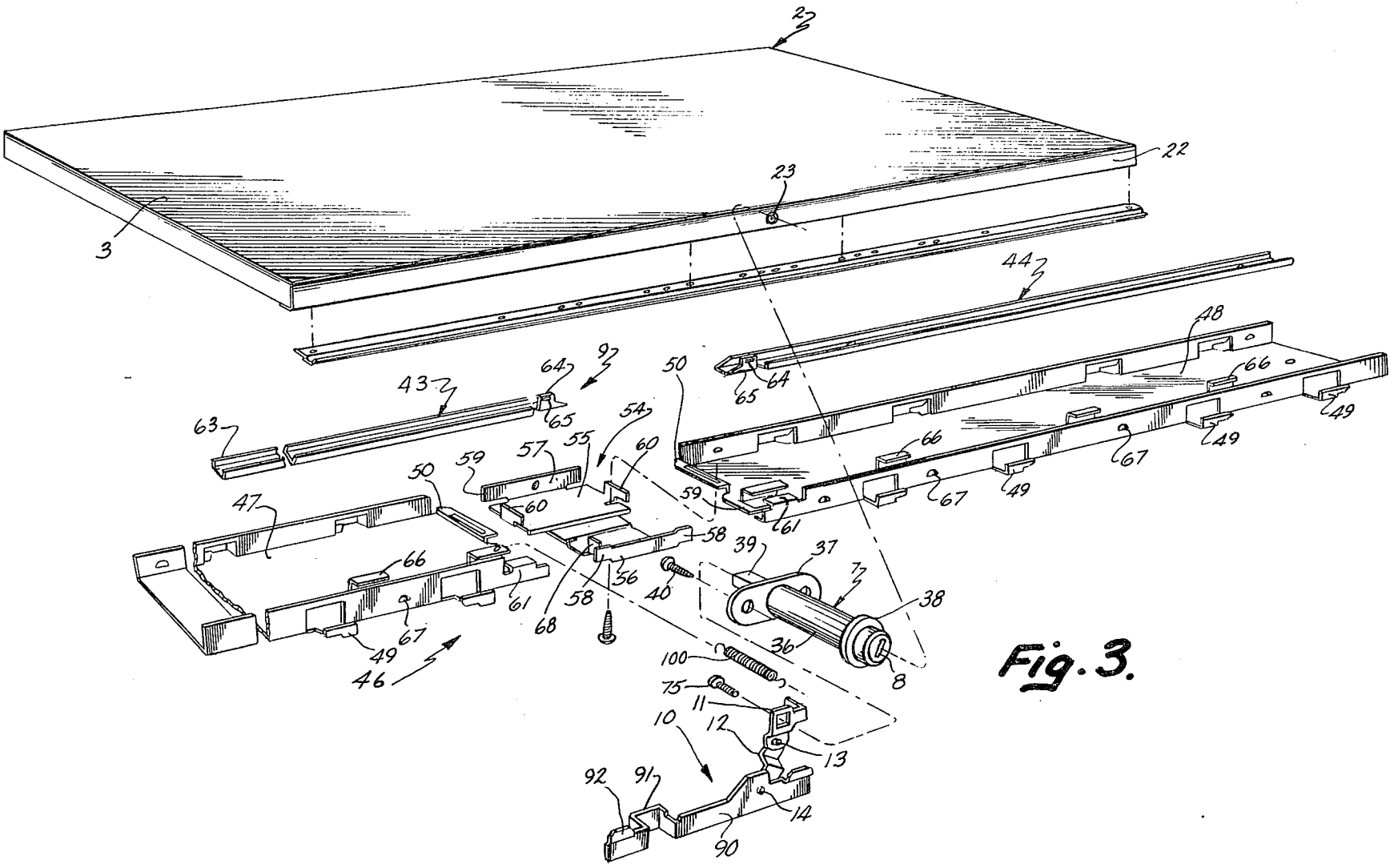
FIG. 3 is an exploded, perspective view of the over-centered lock arrangement.

For purposes of description herein, the terms "upper," "lower," "right," "left," "rear," "front," "vertical," "horizontal," and derivatives thereof shall relate to the invention as oriented in FIGS. 1 and 3. However, it is to be understood that the invention may assume various alternative orientations, except where expressly specified to the contrary The reference numeral 1 (FIG. 1) generally designates an over-centered lock arrangement for an office furniture unit 2, such as a desk, a credenza, or other similar work station. Office furniture unit 2 includes a top 3, and one or more pedestals 4 defining at least one closable compartment 5 in the nature of a drawer, cabinet, et cetera, with a lock mechanism 6. A primary lock 7 is mounted in unit 2, and includes conventional lock tumblers (not shown) carried in a plug or cylinder 8, which is rotatable between locked and unlocked positions. A slide mechanism 9 (FIG. 3) is slidably mounted in furniture unit 2, and reciprocates laterally to shift compartment lock mechanism 6 between the locked and unlocked positions. A cam lock assembly 10 (FIG. 3) includes a crank arm 11 connected with tumbler cylinder 8, and an actuator arm 12, having opposite ends pivotally connected with crank arm 11 and slide mechanism 9 at first and second pivot points 13 and 14 respectively, whereby rotation of tumbler cylinder 8 reciprocates lock mechanism 9. In the locked position (FIG. 8), the first and second pivot points 13 and 14 respectively assume an over-centered relationship with respect to the axis of rotation of tumbler cylinder 8, whereby external forces applied to slide mechanism 9 in a direction to force the lock open, urge tumbler cylinder 8 further toward the lock position for improved security, and to prevent damage to the lock tumblers.

Over-centered lock arrangement 1 is particularly adapted for in-top lock installations, such as the structure illustrated herein, in which primary lock 7 is concealed within top 3. However, it is to be understood that lock arrangement 1 can also be used in conjunction with alternative arrangements.

The illustrated furniture unit 2 (FIG. 1) comprises a desk, having end panels, which support top 6, and a rear panel 21. Top 6 has a hollow construction in which primary lock 7 is mounted. The forward edge 22 (FIG. 3) of top 6 includes an aperture 23 through which the forward end of primary lock 7 protrudes.

Pedestals 4 (FIG. 1) are suspended from the lower side of top 3, at selected positions. In this example, furniture unit 2 includes a single pedestal 4 mounted on the right-hand side of desk 2. However, it is to be understood that furniture unit 2 may include more than one pedestalI and that each pedestal 4 is suspended from top 6 at various positions therealong. The illustrated pedestal 4 comprises a drawer unit, having first and second drawers 26 and 27 slidably mounted in an open-top housing 28. Compartment lock mechanism 6 is manipulated by lateral or side-to-side motion, and comprises a front pivotal latch 29 that selectively engages a forward portion of drawers 26 and 27, and locks the same closed. An upstanding actuator rod 30 is mounted in bracket 31, and is connected with front latch 29 by a link 32 and an adjustable clip 33.

Primary lock 7 (FIG. 3) preferably comprises a key lock having a stationary barrel or housing 36 with tumbler cylinder 8 mounted therein for rotation between locked and unlocked positions. Key lock housing 36 includes an apertured flange 37 at the rearward end thereof to facilitate mounting the lock in top 3, and a coller 38 at the forward end of housing 36 to center the lock in the forward edge 22 of top 3. A drive shaft 39 extends from the rear of housing 60, is connected with tumbler cylinder 8, and rotates therewith. Shaft 39 has a non-cylindrical end to facilitate the attachment of crank arm 11. Except as noted herein, key lock 7 otherwise has a conventional construction, and includes a plurality of tumblers (not shown) mounted in cylinder 8, and means for positively stopping rotation of cylinder 8 at the locked and unlocked positions. The illustrated tumbler cylinder 8 rotates 90° between the locked and unlocked positions.

Key lock 7 is preferably detachably mounted in top 3 by fasteners 40, in the nature of sheet metal screws or the like, which extend through the apertures of housing collar 38, as described in greater detail hereinafter.

Figure 10:
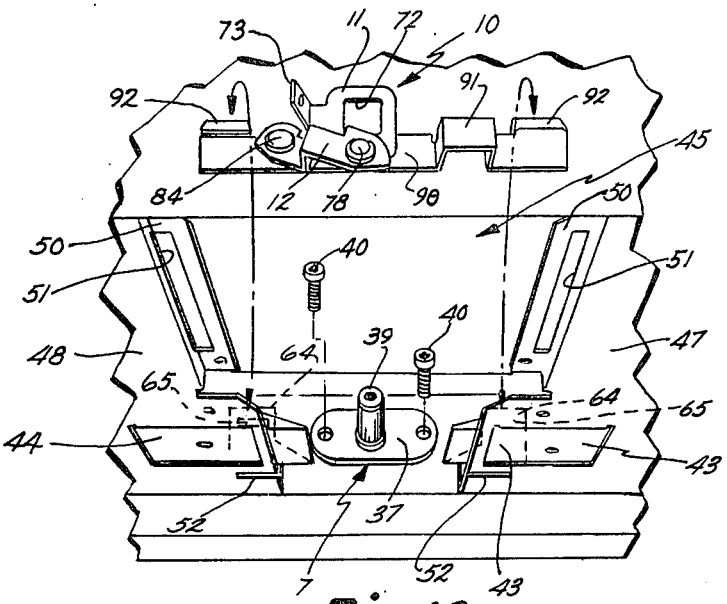
FIG. 10 is an exploded, rear perspective view of the lock arrangement, with the cam lock assembly disassembled.
Figure 11:
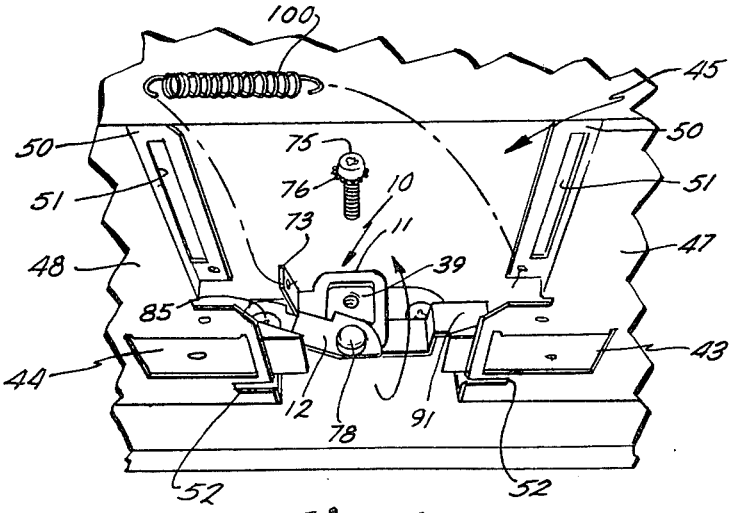
FIG. 11 is a rear perspective view of the lock arrangement, wherein the cam lock assembly is partially assembled.

Slide mechanism 9 is described in detail in my copending U.S. patent application entitled Lock Arrangement for Office Furniture Units, referenced hereinabove, and generally comprises a pair of lock slides 43 and 44, which are positioned in an inverted U-shaped channel 45 (FIGS. 10 and 11) that opens downwardly from the lower side of top 3. A removable cover assembly 46 (FIG. 3) encloses channel 45 to permit only authorized access to lock arrangement 1.

Cover assembly 46 comprises left and right-hand end covers 47 and 48 respectively, which are positioned over opposite ends of channel 45, and have hook-shaped hangers 49 along the side edges thereof to slidingly lock the covers onto channel 45. Hangers 49 are oriented toward the outer ends of covers 47 and 48, and are received in mating, elongate slots in the lower side of top 3, such that end covers 47 and 48 are diverged into a locked position over the open side of channel 45. The interior ends of end covers 47 and 48 have inverted, L-shaped flanges 50 at the rearward portions thereof, with elongate slots 51 in the horizontal leg, and are oriented in a fore-to-aft direction. A second pair of slots 52 extend through the interior ends of end covers 47 and 48 at the forward portion thereof, and are oriented generally parallel with the longitudinal axis of the end covers 47 and 48.

A center cover 54 is inserted between the interior ends of covers 47 and 48 to enclose the center portion of channel 45, and prevent convergence of end covers 47 and 48 toward the unlocked position. Center cover 54 includes a base 55, with forward and rearward end walls 56 and 57 upstanding therefrom.

Slots extend along the lower edges of end walls 56 and 57 to form two pairs of wing-shaped free ends 58 and 59 respectively. A pair of hook-shaped hangers 60 are connected with the side edges of base 55, and include forwardly extending prongs which are closely received through slots 51. The forward end wall 56 of center cover 54 is received through slots 52, and is captured by flanges 61 when translated forwardly into the locked position.

The left and right-hand lock slides 43 and 44 respectively have a generally U-shaped transverse cross-sectional configuration, comprising a base with upstanding sidewalls. The bases of lock slides 43 and 44 include a series of aligned apertures or perforations 63 therethrough in which the pedestal actuator rod 30 is captured. The interior ends (FIG. 4) of lock slides 43 and 44 include integrally formed, upstanding tabs 64, with horizontal slots 65 through the upper ends of the tabs. Tabs 64 are formed by laterally slicing the channel, and forming the tab upwardly, such that a narrower channel portion is formed between tab 64 and the rearward sidewall of lock slides 43 and 44.

In the illustrated structure, pierced, inverted L-shaped flanges 66 project upwardly from the base of end covers 47 and 48, and are aligned in a parallel relationship with the forward sidewall of end covers 47 and 48. Pierced protuberances 67 are formed in the forward sidewalls of end covers 47 and 48, and extend laterally outwardly toward flanges 66. The distance between the vertical leg of flange 66, and the interior surface of the forward sidewall of end covers 47 and 48 is slightly greater than the width of lock slides 43 and 44 to closely receive the same therebetween. The distance between the base of end covers 47 and 48 and the horizontal leg of flange 66, as well as the outwardly protruding portion of protuberances 67 is substantially equal to the height of the associated sidewalls of lock slides 43 and 44, whereby flanges 66 and protuberance 67 form guides in cover members 46 and 47 in which lock slides 43 and 44 reciprocate.

Center cover 54 includes an upstanding tab 68 along a foward portion of the left-hand side of base 55. In the locked position, the interior end of left-hand lock slide 43 is positioned directly behind tab 68, thereby preventing rearward translation of center cover 54. When key lock 7 is shifted to the unlocked position, the left-hand lock slide 43 retracts into left-hand cover 47 to permit center cover 54 to slide rearwardly. In this manner, cover assembly 46 is fully locked when key lock 7 is in the locked position to prevent tampering and/or surreptitious entry. When key lock 7 is shifted to the unlocked position by authorized personnel, cover assembly 46 can be easily removed to access the lock for repair or replacement.

A link 90 detachably interconnects the interior ends of the left and right-hand lock slides 43 and 44, such that they reciprocate together. Link 90 comprises an elongate strap, having a laterally offset medial portion 91 which guides the link as it is translated side-to-side. The opposite ends of link 90 have inverted L-shaped tabs 92 upstanding therefrom, which are shaped for close reception in the slots 65 in tabs 64 of lock slides 43 and 44 to detachably interconnect the same. The upper edge 93 of link 90 includes a recessed portion 94 to the right of pivot point 14 (as viewed in FIGS. 4 and 5) which permits cam lock assembly 10 to fold together into a compact, low-profile configuration within the top 3 of furniture unit 2.

Figure 4:
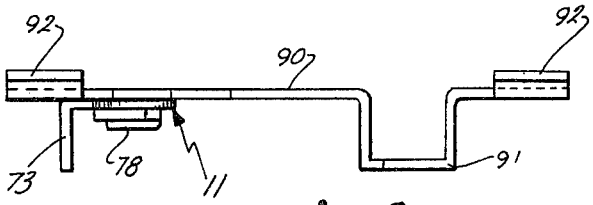
FIG. 4 is a top plan view of a cam lock assembly for the lock arrangement.
Figure 5:
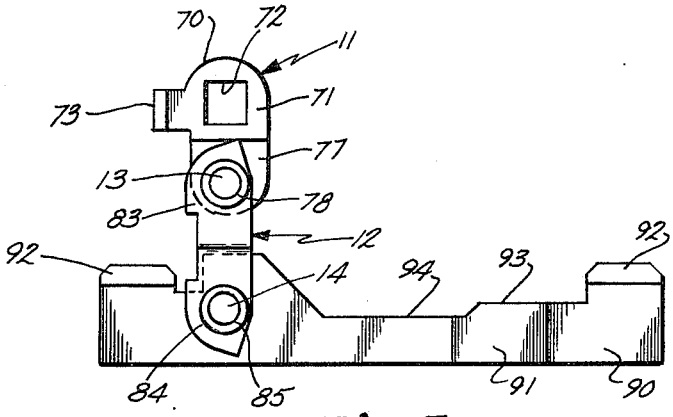
FIG. 5 is a front elevational view of the cam lock assembly.
Figure 6:
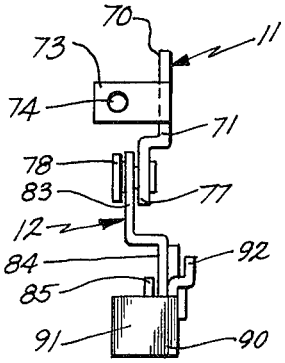
FIG. 6 is an end elevational view of the cam lock assembly.
Figure 7:
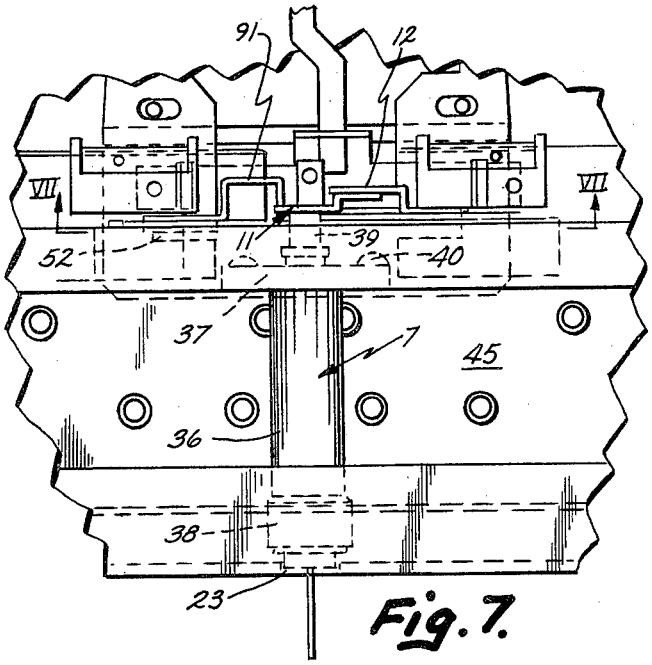
FIG. 7 is a bottom plan view of the lock arrangement, shown installed in the top of the furniture unit.

With reference to FIGS. 4–6, crank arm 11 comprises a generally Z-shaped bracket 70, having a first leg 71 with a square aperture 72 therethrough, which is shaped to closely receive the square, interior end of lock cylinder shaft 39 therein, such that crank arm 11 is keyed to and rotates with tumbler cylinder 8. A fastener 75 (FIG. 11) with lock washer 76 is threadedly engaged in a mating aperture in the interior end of cylinder shaft 39, and detachably retains crank arm 11 on cylinder shaft 39. An arm 73 (FIGS. 4–6) extends rearwardly from the left-hand side of bracket leg 71 (as viewed from the rear of the assembly in FIG. 5), and includes an aperture 74 for purposes to be described below. The opposite leg 77 of bracket 70 includes a circular aperture in which a connecting pin 78 is received.

Actuator arm 12 also as a generally Z-shape configuration in end elevational view, with substantial identical, irregularly shaped end legs 83 and 84 respectively. End leg 83 includes an aperture through which end 78 is received to pivotally connect the same with crank arm 11. The opposite end leg 84 of actuator arm 12 also includes an aperture therethrough, in which pin 85 is received to pivotally connect the same with link 90. Rotation of crank arm 11 by manipulating tumbler cylinder 8 reciprocates link 90 laterally to lock and unlock pedestal compartment 5.

Figure 8:
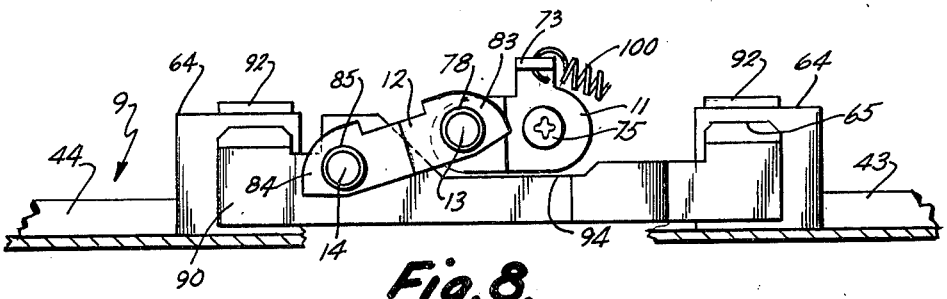
FIG. 8 is a rear elevational view of the cam lock assembly, shown in a locked position.
Figure 9:
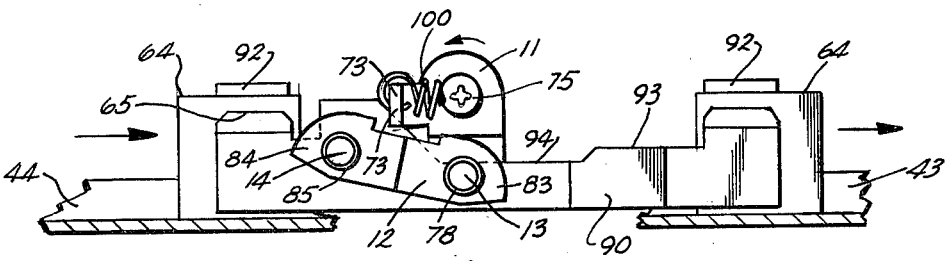
FIG. 9 is a rear elevational view of the cam lock assembly, shown in an unlocked position.

A coil spring 100 (FIG. 11) resiliently urges cam lock assembly 10 into the normally locked position illustrated in FIG. 8. In this example, one end of coil spring 100 is received through aperture 74 in arm 73 of crank arm 11, and the other end is connected with the flange 50 of left-hand end cover 47.

In the locked position illustrated in FIG. 8, first and second pivot points, 13 and 14 respectively, assume an over-centered position with respect to the axis of rotation of tumbler cylinder 8. As lock cylinder 8 is rotated from the unlocked position to the locked position, pins 78 and 85 come into alignment with fastener 75, and then pass slightly over center as lock cylinder 8 engages the positive stop in lock housing 36 for the locked position. As previously noted, spring 100 resiliently retains cam lock assembly 10 in the over-centered, locked position. In this position, any external forces which are applied to lock slides 43 or 44 in a direction to unlock the lock (to the right as viewed in FIG. 8), urge the lock further toward the locked position, so that these forces are not transmitted to the locked tumblers. Hence, forces on lock slides 43 or 44 which are caused by misalignment between desk top 3 and the actuator rod 30 of pedestal 4 will not cause the tumblers to stick in the mating portion of lock housing 36, such that the key can be easily inserted and withdrawn, and lock cylinder 8 will rotate smoothly. In the event of tampering or surreptitious entry, the lock tumblers will not be deformed, because the external forces are resisted solely by the internal, positive stop in the lock 7.

To unlock furniture unit 2, the user inserts the key and rotates lock cylinder 8 90° in a clockwise direction (as viewed from the front of the lock), thereby shifting lock slides 43 and 44 to the left, and unlocking compartments 5.

To change key lock 7, the key is inserted into the lock, and tumbler cylinder 8 is rotated to the unlocked position. Center cover 54 is pushed rearwardly until hangers 60, and the free ends 58 and 59 of cover walls 56 and 57 are vertically aligned with their mating apertures. Center cover 54 is then pulled downwardly out of engagement with the top 3. Actuator spring 100 is removed, and fastener 75 is detached so that crank arm 11 can be slid rearwardly off of lock shaft 39. Cam lock assembly 10 is then rotated upwardly, in the direction of the arrow shown in FIG. 11, and link tabs 92 are withdrawn from the mating slots 65 in the interior ends of lock slides 43 and 44. Next, lock fasteners 40 are removed, and lock 7 is pulled rearwardly out through channel 45. Lock 7 is replaced by simply reversing the above-described sequence of steps.

Over-centered lock arrangement 1 provides greatly increased security, reduces tumbler wear, and provides smooth lock operation.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A lock arrangement for office furniture units such as desks, credenzas, and the like, that include one or more pedestals having at least one closable compartment therein, such as a drawer, a cabinet or the like, with means for locking said compartment closed, said lock arrangement comprising:

a primary lock mounted in said unit, and having lock tumblers mounted in a cylinder rotatable between locked and unlocked positions;

at least one lock slide slidably supported in said unit, and connected with said compartment locking means, whereby reciprocation of said slide lock between locked and unlocked positions locks and unlocks said compartment;

a cam lock assembly comprising a crank arm extending radially of the axis of rotation of said tumbler cylinder, and rotating therewith; an actuator arm having a first end pivotally connected with said crank arm at a first pivot point, and a second end pivotally connected with said lock slide at a second pivot point, whereby rotation of said tumbler cylinder reciprocates said lock slide; said first and second pivot points being positioned to assume an over-centered relationship with respect to the axis of rotation of said tumbler cylinder in the locked position, whereby external forces applied to said lock slide in a direction to force said lock arrangement unlocked, rotatably urge said tumbler cylinder further into the locked position for improved security, and to prevent damage to said lock tumblers.

2. A lock arrangement as recited in claim 1, including:
means for resiliently urging said lock actuator assembly into the over-centered, locked position.

3. A lock arrangement as recited in claim 2, wherein:
said furniture unit includes a hollow top; and
said lock arrangement is mounted within said top.

4. A lock arrangement as recited in claim 3, wherein:
said primary lock comprises a key lock.

5. A lock arrangement as recited in claim 4, wherein:
said compartment locking means includes an upstanding actuator rod shaped to engage said lock slide at multiple positions therealong.

6. A lock arrangement as recited in claim 5, wherein:
said resilient urging means comprises a spring having one end anchored stationary within said top, and the other end connected with said crank arm.

7. A lock arrangement as recited in claim 1, wherein:
said furniture unit includes a hollow top; and
said lock arrangement is mounted within said top.

8. A lock arrangement as recited in claim 1, wherein:
said primary lock comprises a key lock.

9. A lock arrangement as recited in claim 1, wherein:
said compartment locking means includes an upstanding actuator rod shaped to engage said lock slide at multiple positions therealong.

10. A lock arrangement for office furniture units such as desks, credenzas, and the like, that include one or more pedestals having at least one closable compartment therein, such as a drawer, a cabinet or the like, with means for locking said compartment closed, said lock arrangement comprising:

a primary lock mounted in said unit, and having lock tumblers mounted in a cylinder rotatable between locked and unlocked positions;

a lock slide having a three-part construction comprising first and second slide segments with a link interconnecting adjacent interior ends of said first and second slide segments, at least one of said slide segments being connected with said compartment locking means whereby reciprocation of said one slide between locked and unlocked positions locks and unlocks said compartment; and a cam lock assembly comprising a crank arm extending radially of the axis of rotation of said tumbler cylinder, and rotating therewith; an actuator arm having a first end pivotally connected with said crank arm at a first pivot point, and a second end pivotally connected with said link at a second pivot point, whereby rotation of said tumbler cylinder reciprocates said lock slide; said first and second pivot points being positioned to assume an over-centered relationship with respect to the axis of rotation of said tumbler cylinder in the locked position, whereby external forces applied to said lock slide in a direction to force said lock arrangement unlocked, rotatably urge said tumbler cylinder further into the locked position for improved security, and to prevent damage to said lock tumblers.

11. A lock arrangement as recited in claim 10, including:
means for detachably connecting opposite ends of said link with the interior ends of said first and second slide segments.

12. A lock arrangement as recited in claim 11, wherein said link detachable connecting means comprises:
L-shaped tabs upstanding from the opposite ends of said link;
transverse slots in the interior ends of said lock slides, shaped to closely receive said tabs therethrough.

13. A lock arrangement as recited in claim 12, including:
means for detachably connecting said crank arm with said tumbler cylinder.

14. A lock arrangement as recited in claim 10, including:
means for detachably connecting opposite ends of said link with the interior ends of said first and second slide segments.

15. A lock arrangement as recited in claim 14, wherein said link detachable connecting means comprises:
L-shaped tabs upstanding from the opposite ends of said link;
transverse slots in the interior ends of said lock slides, shaped to closely receive said tabs therethrough.

16. A lock arrangement as recited in claim 1, including:
means for detachably connecting said crank arm with said tumbler cylinder.

17. A lock arrangement as recited in claim 10, including:
means for resiliently urging said lock actuator assembly into the over-centered, locked position.

18. A lock arrangement as recited in claim 17, wherein:
said furniture unit includes a hollow top; and
said lock arrangement is mounted within said top.

19. A lock arrangement as recited in claim 18, wherein:
said primary lock comprises a key lock.

20. A lock arrangement as recited in claim 19, wherein:
said compartment locking means includes an upstanding actuator rod shaped to engage said lock slide at multiple positions therealong.

21. A lock arrangement as recited in claim 20, wherein:
said resilient urging means comprises a spring having one end anchored stationary within said top, and the other end connected with said crank arm.

* * * * *

UNITED STATES PATENT AND TRADEMARK OFFICE

CERTIFICATE OF CORRECTION

PATENT NO. : 4,445,729

DATED : May 1, 1984

INVENTOR(S) : Douglas Scheerhorn

It is certified that error appears in the above-identified patent and that said Letters Patent is hereby corrected as shown below:

Column 1, line 25:

"lock" should be --locked--

Column 1, line 27:

"positions" should be --position--

Column 3, line 3:

"lock" should be --locked--

Column 3, line 12:

after "panels" insert --20--

Column 3, line 39:

"coller" should be --collar--

Signed and Sealed this

Sixteenth Day of October 1984

[SEAL]

*Attest:*

*Attesting Officer*

GERALD J. MOSSINGHOFF

*Commissioner of Patents and Trademarks*